US009010218B2

(12) United States Patent
Peterson et al.

(10) Patent No.: US 9,010,218 B2
(45) Date of Patent: Apr. 21, 2015

(54) BUNTER TECHNOLOGY

(75) Inventors: Scott N. Peterson, Cottage Grove, MN (US); Paul T. Johnson, Stillwater, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 1035 days.

(21) Appl. No.: 12/780,579

(22) Filed: May 14, 2010

(65) Prior Publication Data

US 2011/0277595 A1 Nov. 17, 2011

(51) Int. Cl.

| | |
|---|---|
| ***B21K 5/20*** | (2006.01) |
| ***B44B 5/00*** | (2006.01) |
| ***B44B 5/02*** | (2006.01) |

(52) U.S. Cl.

CPC ..... *B21K 5/20* (2013.01); *B44B 5/0052* (2013.01); *B44B 5/022* (2013.01); *B44B 5/026* (2013.01)

(58) Field of Classification Search

USPC ..... 76/101.1, 107.1; 72/412; 101/28, 128.4

See application file for complete search history.

(56) References Cited

U.S. PATENT DOCUMENTS

| | | | | |
|---|---|---|---|---|
| 792,781 | A * | 6/1905 | Lentz | 101/28 |
| 1,505,336 | A * | 8/1924 | Hartog | 76/107.1 |
| 1,650,908 | A | 11/1927 | Ramsey | |
| 1,798,655 | A * | 3/1931 | Brugiere | 101/5 |
| 2,394,842 | A | 2/1946 | Catlin et al. | |
| 2,416,629 | A | 2/1947 | Kifer | |
| 2,668,345 | A * | 2/1954 | Eckstein | 86/19.5 |
| 2,735,390 | A * | 2/1956 | Engel | 72/60 |
| 2,904,873 | A | 9/1959 | Hild | |
| 3,061,908 | A * | 11/1962 | Duffield | 86/19.6 |
| 3,712,157 | A | 1/1973 | Kratz et al. | |
| 4,726,215 | A * | 2/1988 | Molinari | 72/478 |
| D372,493 | S * | 8/1996 | Sculler | D18/18 |
| 6,003,228 | A * | 12/1999 | Riggio | 29/896.41 |
| 6,073,552 | A * | 6/2000 | Cruse et al. | 101/32 |
| 6,833,911 | B2 * | 12/2004 | Lizotte | 356/71 |
| 7,111,423 | B2 * | 9/2006 | Lizotte et al. | 42/1.01 |
| 7,240,419 | B2 * | 7/2007 | Okuno et al. | 29/603.14 |
| 8,222,560 | B2 * | 7/2012 | Sigler et al. | 219/117.1 |
| 2004/0027630 | A1 * | 2/2004 | Lizotte | 359/15 |
| 2004/0217173 | A1 * | 11/2004 | Lizotte et al. | 235/462.01 |
| 2005/0071980 | A1 * | 4/2005 | Rasmussen et al. | 29/462 |
| 2005/0188576 | A1 * | 9/2005 | Lizotte et al. | 42/1.01 |
| 2005/0241203 | A1 * | 11/2005 | Lizotte et al. | 42/1.01 |
| 2006/0026880 | A1 * | 2/2006 | Lizotte et al. | 42/1.01 |
| 2006/0174531 | A1 * | 8/2006 | Lizotte et al. | 42/1.01 |
| 2008/0184873 | A1 * | 8/2008 | Martini Filho | 86/1.1 |
| 2009/0127232 | A1 * | 5/2009 | Sigler et al. | 219/117.1 |
| 2009/0255908 | A1 * | 10/2009 | Sigler et al. | 219/91.2 |

FOREIGN PATENT DOCUMENTS

WO WO 2004061795 A2 * 7/2004

OTHER PUBLICATIONS

AccurateShooter.com Bulletin, "How Cartridge Brass Is Made," Jun. 15, 2007, http://accurateshooter.wordpress.com/2007/06/15/how-cartridge-brass-is-made/, 16 pages.

(Continued)

*Primary Examiner* — Essama Omgba

(74) *Attorney, Agent, or Firm* — Fredrikson & Byron, P.A.

(57) ABSTRACT

The invention provides methods for making bunters used to form headstamp indicia into ammunition cases. The invention also provides bunter blanks that are specially configured to yield high quality bunters.

34 Claims, 10 Drawing Sheets

(56) References Cited

OTHER PUBLICATIONS

DeGamo, E. Paul, et al., "Materials and Processes in Manufacturing," 1997, Eighth Edition, Prentice Hall, 4 pages.

International Search Report and Written Opinion for PCT/US2011/032825, mailed Mar. 9, 2012, 11 pages.

* cited by examiner

BUNTER TECHNOLOGY

FIELD OF THE INVENTION

The present invention relates generally to making a bunter of the type used to imprint indicia on ammunition cartridge cases. Specifically, this invention relates to methods and blanks for making such bunters.

BACKGROUND OF THE INVENTION

The base of an ammunition cartridge case commonly has a "headstamp," which comprises recessed lettering or other recessed indicia showing who manufactured the case. The headstamp may also indicate the caliber and year of manufacture. As is well known, the base typically also has a primer pocket. The headstamp, primer pocket, or both can be formed in the base using a hardened metal plug called a "bunter."

The bunter has raised lettering around its face. Thus, when the face of the bunter is pressed against the base of the case, the raised lettering on the bunter forms corresponding recessed letters in the base.

The raised letters on bunters have been formed on the bunter's face by EDM or engraving. Unfortunately, both of these techniques leave the bunter's face with considerable surface roughness, and this roughness is transferred to the cartridge case when the bunter is used to stamp the headstamp on the case. Moreover, the EDM and engraving techniques require a substantial amount of time. Further, when using EDM or engraving, the bunter is not workhardened during the forming process.

It would be desirable to provide a fast, efficient process for forming raised indicia on the face of a bunter. It would be particularly desirable to provide a process that leaves the face of the bunter with a smooth, workhardened surface. It would also be desirable to provide a bunter blank configuration that facilitates such a process.

SUMMARY OF THE INVENTION

Certain embodiments of the present invention provide a method of producing a bunter that is configured to stamp recessed headstamp indicia into a base of an ammunition cartridge case. In the present embodiments, the method involves providing a bunter blank having a generally ring-shaped working face from which projects a radial center protrusion. The radial center protrusion is configured for receipt in a primer pocket of the cartridge case's base during stamping of the recessed headstamp indicia. The bunter blank's generally ring-shaped working face surrounds the radial center protrusion and has an outwardly rounded configuration. The method comprises providing a hub having a generally ring-shaped contact face that defines indicia recesses. The generally ring-shaped contact face of the hub surrounds a central pocket. The method includes assembling the generally ring-shaped working face of the bunter blank against the generally ring-shaped contact face of the hub such that the bunter blank's radial center protrusion is received in the hub's central pocket and applying enough force to the thus assembled bunter blank and hub that material defining the outwardly rounded configuration of the bunter blank's working face is deformed into the hub's indicia recesses so as to form raised indicia on the working face.

Other embodiments provide a bunter blank to be machined into a bunter for stamping recessed headstamp indicia into a base of an ammunition cartridge case. In the present embodiments, the bunter blank preferably comprises metal and includes both a base and a generally ring-shaped working face from which projects a radial center protrusion. The radial center protrusion preferably has a cylindrical shape and is configured for receipt in a primer pocket of the cartridge case's base during stamping of the recessed headstamp indicia. In the present embodiments, the bunter blank's generally ring-shaped working face has a hump that encircles the radial center protrusion, and this hump has an aspect ratio of greater than 7. Preferably, the hump is located radially outside of an inwardly radiused section adjacent to a base portion of the radial center protrusion.

In certain embodiments, the invention provides a method of producing a bunter that is configured to stamp recessed headstamp indicia into a base of an ammunition cartridge case. The method involves providing a bunter blank having a working face from which projects a radial center protrusion. The radial center protrusion is configured for receipt in a primer pocket of the cartridge case's base during stamping of the recessed headstamp indicia. In the present embodiments, the bunter blank's working face has a hump that encircles the radial center protrusion. The method includes providing a hub having a contact face that defines indicia recesses. The contact face of the hub surrounds a central pocket. The present method embodiments comprise assembling the working face of the bunter blank against the contact face of the hub, such that a peak of the hump is aligned with the indicia recesses and such that the radial center protrusion is received in the central pocket, and applying enough force to the thus assembled bunter blank and hub that material defining the hump is deformed into the indicia recesses so as to form raised indicia on said working face.

Some embodiments of the invention provide a method of producing a bunter that is configured to stamp recessed headstamp indicia into a base of an ammunition cartridge case. In the present embodiments, the method comprises providing a bunter blank having a working face with a hump defined by a generally toroidal surface (in the present embodiments, the radial center protrusion is optional and may be omitted). The method involves providing a hub having a contact face that defines indicia recesses (the contact face of the hub is not required to have a central pocket, though, it is preferred). The method comprises assembling the working face of the bunter blank against the contact face of the hub, such that a peak of the hump is aligned with the indicia recesses, and applying enough force to the thus assembled bunter blank and hub that material defining the hump is deformed into the indicia recesses so as to form raised indicia on the working face.

Certain embodiments provide a bunter blank to be machined into a bunter for stamping recessed headstamp indicia into a base of an ammunition cartridge case. In the present embodiments, the bunter blank preferably comprises metal and includes both a base and a working face (in the present embodiments, the radial center protrusion is optional and may be omitted). Preferably, the bunter blank's working face has a hump defined by a generally toroidal surface. In the present embodiments, the hump has an aspect ratio of greater than 3.5, greater than 5, or even greater than 7. Preferably, the hump is located radially inside of (e.g., is encircled by) a planar perimeter surface (or "flat").

DETAILED DESCRIPTION OF PREFERRED EMBODIMENTS

Figure 1A:
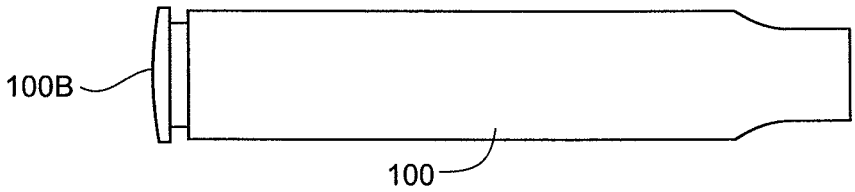
FIG. 1A is a side view of a conventional ammunition casing.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the given examples have many useful alternatives, which fall within the scope of the invention.

The invention provides a cold forming process for producing a bunter configured to stamp recessed headstamp indicia into a base of an ammunition cartridge case. The invention also provides a bunter blank configuration that facilitates this process.

Figure 1B:
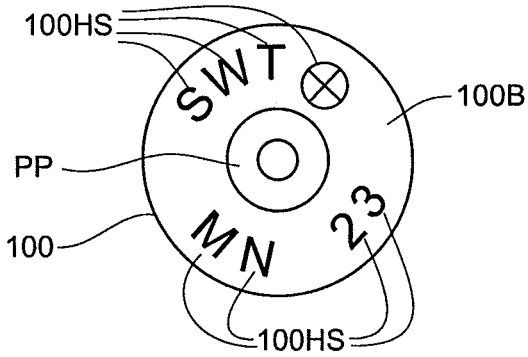
FIG. 1B is a bottom view of the casing of FIG. 1A.
Figure 3C:
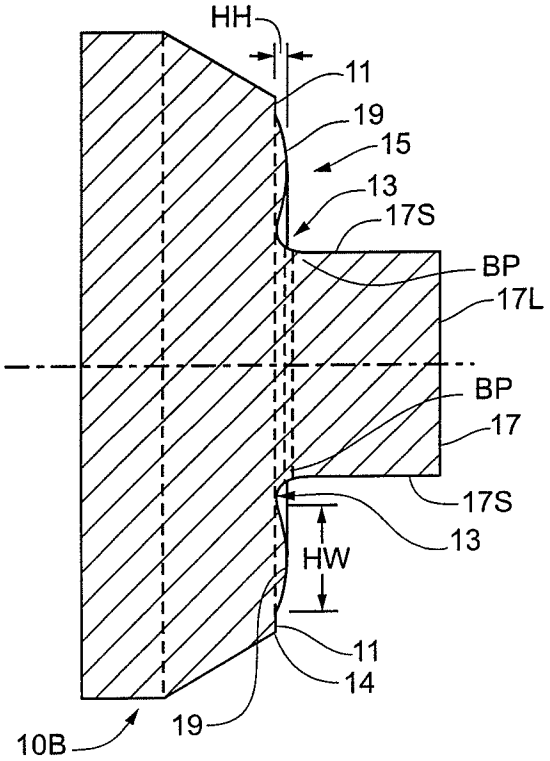
FIG. 3C is a detail view of the leading end region shown in FIG. 3B.
Figure 3A:
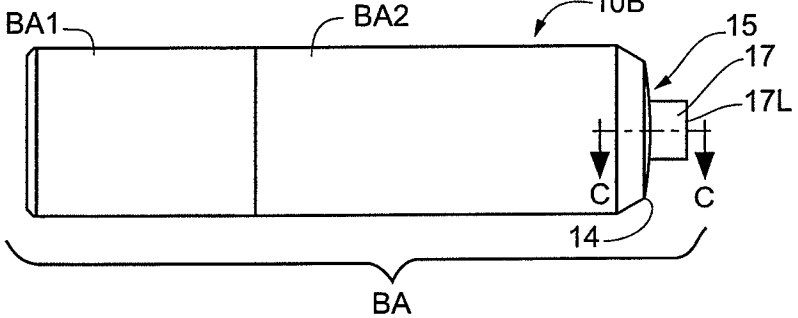
FIG. 3A is a side view of a bunter blank in accordance with certain embodiments of the invention.
Figure 3B:
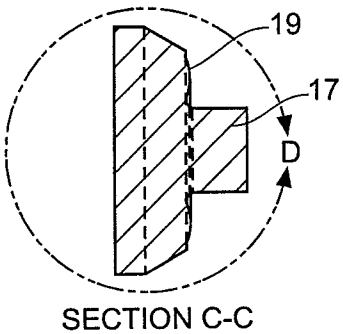
FIG. 3B is a cross-sectional view of a leading end region of the bunter blank of FIG. 3A, the cross section being taken along lines C-C of FIG. 3A.
Figure 4A:
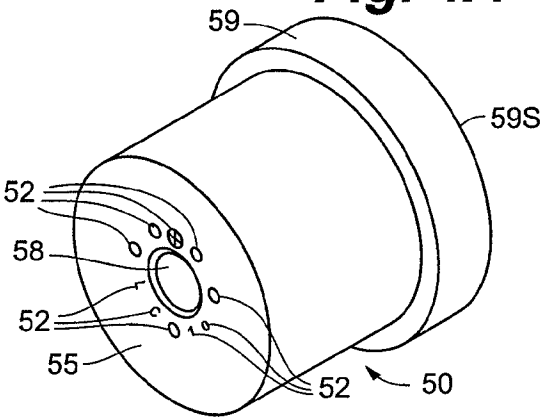
FIG. 4A is a perspective view of a hub used in forming raised indicia on the working face of a bunter in accordance with certain embodiments of the invention.
Figure 4C:
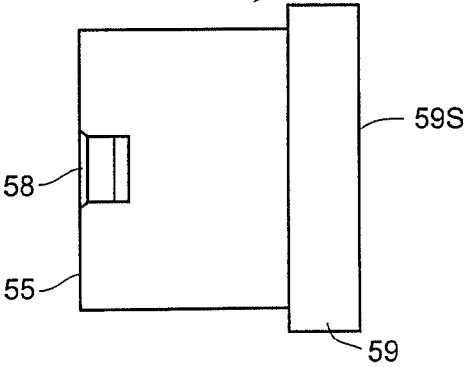
FIG. 4C is a side view of the hub of FIG. 4A.
Figure 4B:
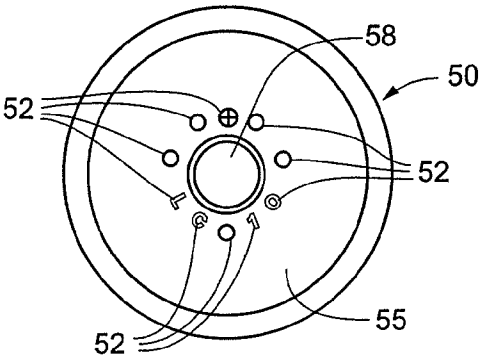
FIG. 4B is a front view of the hub of FIG. 4A.
Figure 4E:
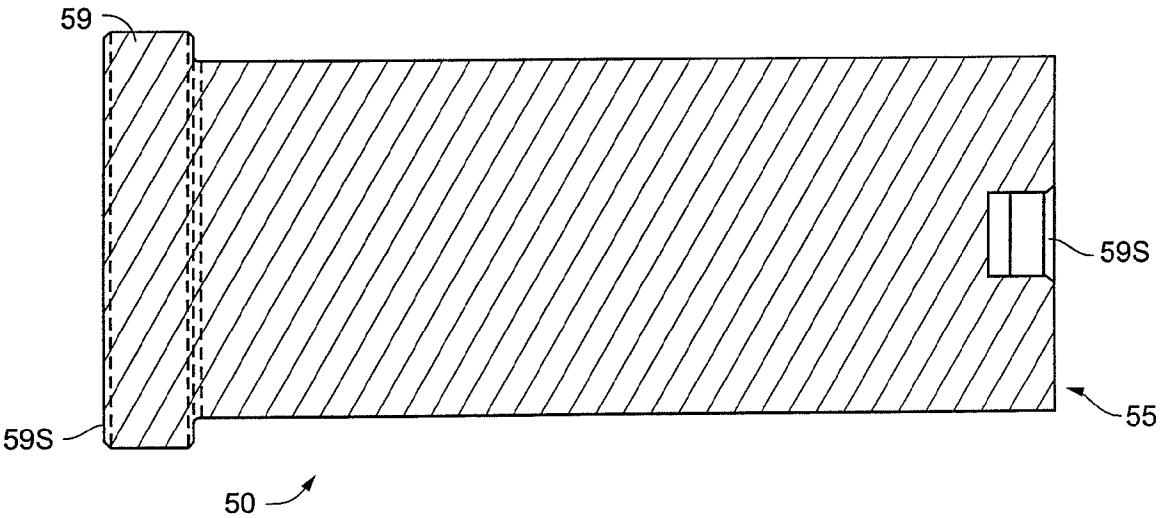
FIG. 4E is a cross-sectional view of the hub of FIG. 4D, the cross section being taken along lines A-A of FIG. 4D.
Figure 4D:
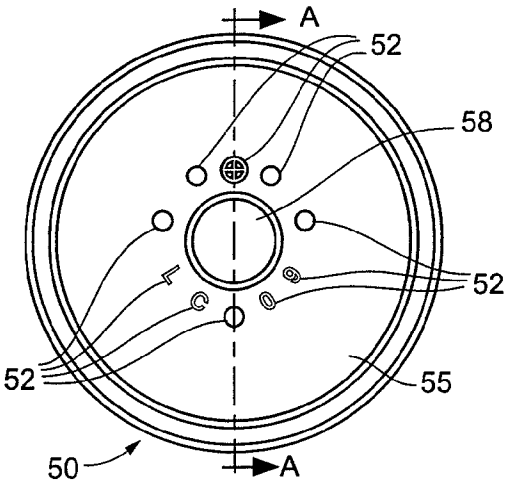
FIG. 4D is a front view of another hub used in forming raised indicia on the working face of a bunter in accordance with certain embodiments of the invention.

The present cold forming process forms raised indicia on the working face of a bunter. The process starts with a bunter blank having a working face with a special outwardly rounded configuration. FIGS. 3A-3C depict an exemplary bunter blank 10B in accordance with certain embodiments of the invention. Here, the bunter blank 10B has a working face 15 from which projects a radial center protrusion 17. The illustrated working face 15 is generally ring shaped, although this is not strictly required. The radial center protrusion 17 is configured for receipt in a primer pocket PP of the cartridge case's base 100B (see FIGS. 1A and 1B) during stamping of the recessed headstamp indicia 100HS. The bunter blank's working face 15 surrounds the radial center protrusion 17 and has an outwardly rounded configuration 19. In the embodiment illustrated, the working face 15 is generally ring shaped and encircles the radial center protrusion 17. While this will typically be preferred, the working face 15 can be provided in different shapes.

Applicants have discovered that by providing the working face 15 of the bunter blank 10B with an outwardly rounded configuration 19 having a high aspect ratio, particularly good results can be obtained. For example, it is possible to obtain fully formed letters (and/or other indicia) on the working face of the resulting bunter without objectionable distortion. In contrast, when the working face of the bunter blank is flat, the flat geometry does not allow the desired raised indicia to readily form into the recesses of the hub. Moreover, when the working face of the bunter blank is flat, the high tonnage required to get any forming of the desired indicia can deform the fixture. Further, when the working face of the bunter blank has a raised non-rounded rectangular or square projection, an outline of the desired raised indicia may be formed, but ridges will commonly be left in the working face of the resulting bunter.

FIG. 3C shows one exemplary shape for the outwardly rounded configuration (or "hump") 19 on the working face 15 of the bunter blank 10B. Here, the outwardly rounded configuration 19 has a width HW that is greater than its height HH. Thus, the illustrated hump 19 has a high aspect ratio. The aspect ratio is defined as the width HW of the hump 19 divided by its height HH. Preferably, the aspect ratio is greater than 3.5, greater than 5, greater than 7, or even greater than 9. In one exemplary embodiment, the aspect ratio is about 9.3.

When the aspect ratio of the hump 19 is within the noted ranges, the cold forming process can provide particularly good results in terms of creating fully formed raised indicia on the working face of the bunter while minimizing distortion of the bunter blank during the cold forming process.

In one group of embodiments, the hump 19 has a height of between 0.005 inch and 0.015 inch. However, this is not required. For example, when the bunter is intended to form headstamps in larger caliber cases, the desired height of the hump may be larger. Similarly, when the bunter is intended to form headstamps in smaller caliber cases, the desired height of the hump may be smaller. When the hump 19 has a height within the noted range, it preferably has an aspect ratio within one or more of the ranges taught above. For the noted height range, for example, the width HW of the hump 19 preferably is between about 0.017 inch and about 0.053 inch, between about 0.025 inch and about 0.075 inch, between about 0.035 inch and about 0.105 inch, or between about 0.045 inch and about 0.135 inch, such as between about 0.046 inch and about 0.140.

In some cases, the height HH of the hump 19 is between 0.006 inch and 0.013 inch, such as from 0.007 inch to 0.010 inch. These exemplary ranges, however, are by no means required. When the hump's height HH is within one or both of these ranges, the hump's width HW can optionally be within any one or more of the ranges that are obtained by multiplying the noted top and bottom ends of the height range by 3.5, 5, 7, or 9.

In the embodiment of FIGS. 3A-3C, the outwardly rounded configuration 19 of the bunter blank's working face 15 is defined by a generally toroidal surface. Preferably, this toroidal surface is defined by a single hump 19 encircling the radial center protrusion 17. Particularly good results can be obtained when using a single hump of this nature. For example, the resulting raised letters (and/or other indicia) can be well defined on both their inner and outer sides, and the tops of the letters can be flat.

As best seen in FIG. 3C, the working face 15 of the illustrated bunter blank 10B defines a planar surface (or "flat") 11 that surrounds the generally toroidal surface defining the hump 19. While this planar surface 11 is not strictly required, it can provide particular advantages. For example, having a small perimeter flat (which can optionally border an outer edge 14 of the working face 15) can make it possible to use a smaller radius hump. This can reduce the overall tonnage needed to form the desired indicia. It can also increase the formability of the hump without impacting the finished product. The illustrated perimeter surface 11 is generally ring shaped and encircles the hump 19, although this too is optional.

In the illustrated embodiment, the bunter blank's radial center protrusion 17 has a cylindrical configuration. While this will typically be preferred, it is not strictly required. The radial center protrusion 17 preferably is an integral projection of (e.g., is defined by the same body as) the bunter blank's working face 15.

In certain preferred embodiments, the outwardly rounded configuration 19 of the bunter blank's working face 15 is located radially outside of an inwardly radiused section 13 adjacent to a base portion BP of the radial center protrusion 17. Reference is made to FIG. 3C. Here, the inwardly radiused section 13 comprises a surface that defines an interior radius located between (e.g., extending between) the hump 19 and a side surface 17S of the radial center protrusion 17. In other words, the illustrated inwardly radiused section 13 is located where the working face 15 comes together with the side 17S of the radial center protrusion 17. When provided, this interior radius is advantageous in that it can form a finished radius that is tangent between the working face 15 and surface 17S.

Thus, one group of preferred embodiments provides a bunter blank 10B to be machined into a bunter 10 for stamping recessed headstamp indicia 100HS into a base 100B of an ammunition cartridge case 100. Preferably, the bunter blank 10B comprises metal and includes both a base BA and a generally ring-shaped working face 15 from which projects a radial center protrusion 17. In the present embodiments, the radial center protrusion 17 has a cylindrical shape and is configured for receipt in a primer pocket PP of the cartridge case's base 100B during stamping of the recessed headstamp indicia 100HS. In these embodiments, the bunter blank's generally ring-shaped working face 15 has a hump 19 (preferably a single hump) that encircles the radial center protrusion 17, and this hump preferably has an aspect ratio of greater than 3.5, greater than 5, greater than 7, or even greater than 9. The hump 19 in these embodiments is located radially outside of an inwardly radiused section 13 adjacent to a base portion BP of the radial center protrusion 17. Optionally, these embodiments can include a planar perimeter surface 11 encircling the hump 19.

In the bunter blank embodiments of the invention, the bunter blank 10B preferably is formed of metal (e.g., steel) and its base BA preferably has a generally cylindrical configuration. The base BA can alternatively have other configurations. However, a cylindrical base configuration will generally be convenient for the present cold forming process.

In one particular non-limiting example, the height HH of the hump 19 is about 0.009 inch and the width HW of the hump is about 0.084 inch. In this example, the bunter blank's radial center protrusion 17 is a cylinder projecting from the bunter blank's working face 15 and having a diameter of about 0.175 inch. In the present example, the bunter blank 10B has the configuration shown in FIGS. 3A-3C. Here, the height of the radial center protrusion 17 is about 0.125 inch, and the width of the working face 15 is about 0.060 inch. The planar surface 11 encircling the hump 19 has a width of about 0.015 inch. The bunter blank 10B is formed of annealed CPMM4 and its base has a diameter of about 0.508 inch. Finally, an interior radius of about 0.015 inch is provided where the working face 15 meets the side 17S of the radial center protrusion 17. These details, however, are merely exemplary; they are by no means limiting to the invention.

Exemplary methods for fabricating the bunter blank will now be described. In one method, the bunter blank is formed of annealed tool steel, such as CPMM4 material, although other suitable materials can be used, including high speed steel. Another exemplary method for fabricating the bunter blank involves the blank being derived from cold work tool steel formed by powder metallurgy processing. The bunter blank is machined using a lathe turning center from a solid billet to the geometry shown in FIGS. 3A and 3C. The details of these fabrication methods, however, are not limiting to the invention.

For the cold work, powder metallurgy-derived steels, from which bunter blanks of the invention can be manufactured, in certain embodiments, the tool steel is formed so as to contain not greater than about 4% tungsten by weight, and preferably not greater than about 2% tungsten by weight. For heavy duty stamping operations, in certain embodiments, the cold work tool steel is formed to contain from about 0.2 to about 4% (and preferably from about 0.5% to about 2%) of tungsten by weight and, preferably, contains from about 5% to about 10% (and most preferably from about 7% to about 9%) of chromium by weight. In a preferred embodiment, the invention provides a durable, wear-resistant bunter blank derived from cold work tool steel formed by powder metallurgy processing and containing tungsten in an amount not greater than about 2% by weight, at least about 7% (and preferably at least about 7.3%) chromium by weight, and not over about 2% of molybdenum by weight.

In addition to the foregoing bunter blank 10B embodiments, the invention provides cold forming methods for forming raised indicia 25 on the working face 15 of a bunter 10. The method involves providing a hub 50 having a contact face 55 (optionally a generally ring-shaped contact face) that defines indicia recesses 52. The contact face 55 of the hub 50 surrounds a central pocket 58. FIGS. 4A-4E depict two exemplary hub configurations. The present methods involve assembling the working face 15 of a bunter blank 10B against the contact face 55 of the hub 50 such that the bunter blank's radial center protrusion 17 is received in the hub's central pocket 58. Sufficient force is applied to the thus assembled bunter blank and hub that material defining the outwardly rounded configuration 19 of the bunter blank's working face 15 deforms into the hub's indicia recesses 52 so as to form raised indicia 25 on the working face 15 of the resulting bunter 10.

The force applied in this cold forming process preferably is supplied by a press (e.g., a cold forge press). This forming of the raised indicia on the working face preferably is initiated while the bunter blank 10B is at room temperature. The method may involve operating the press such that a force of at least 12 tons is applied to the assembled bunter blank and hub. The amount of force used will, of course, vary depending upon a number of factors, including the desired height of the raised indicia 25, the material from which the bunter blank 10B is formed, and the press used.

Figure 2A:
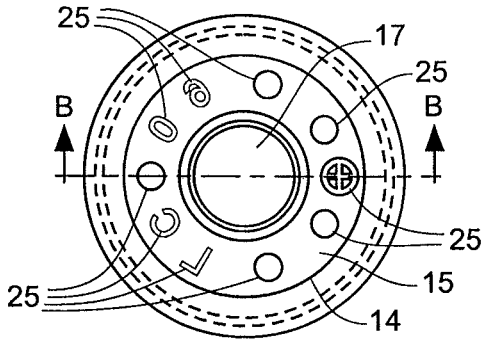
FIG. 2A is a front view of a bunter produced in accordance with certain embodiments of the invention.
Figure 2B:
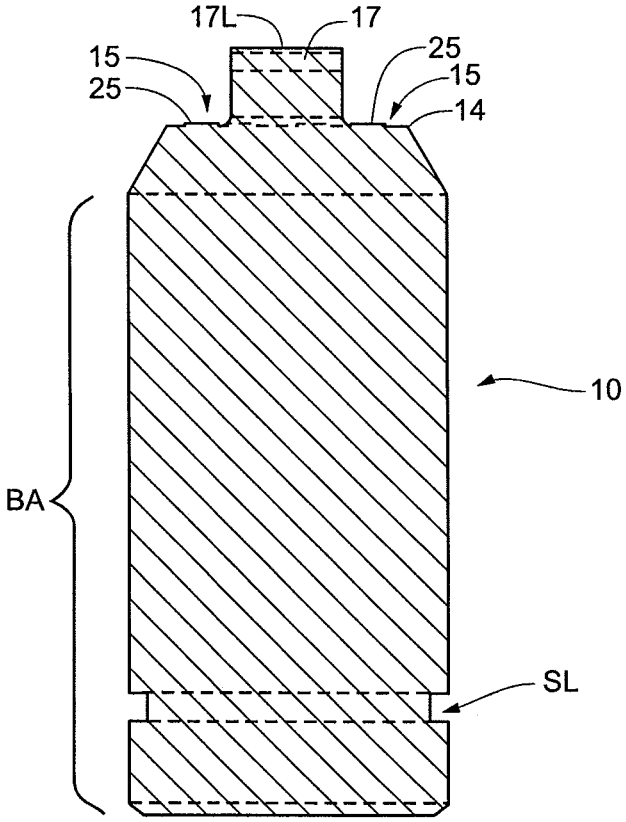
FIG. 2B is a cross-sectional side view of the bunter of FIG. 2A, the cross section being taken along lines B-B of FIG. 2A.

During this forming of the raised indicia 25 on the working face, the outwardly rounded configuration 19 is generally flattened. In more detail, after the cold forming process, the working face 15 of the bunter 10 has a plurality of raised letters, numbers, and/or other indicia, but it preferably is otherwise generally planar. Reference is made to FIG. 2B.

The height of the raised indicia 25 on the bunter's working face 15 will depend upon the depth desired for the recessed headstamp indicia 100HS. In certain embodiments, the height of the raised indicia 25 formed on the bunters working face 15 is between about 0.002 inch and about 0.003 inch. This, however, is merely an exemplary range. Larger or smaller caliber cases may require a different height for the raised indicia 25.

The present cold forming process is advantageous in that it can create a particularly smooth surface on the working face of the resulting bunter. For example, after forming the raised indicia 25, the working face can have an average surface roughness $R_a$ of less than 50 microinches, less than 25 microinches, or even less than 10 microinches. The surface is measured using a stylus moving a radial motion from the center side of the working face 15 to the outer edge 14 of the working face. The measurement excludes the raised indicia 25. The measurement is taken by a CNC surface roughness measurement machine having a resolution of less than 0.1 microinch.

Since the invention involves a cold forming process rather than an EDM process, the working face 15 of the resulting bunter 10 does not have a so-called white layer (or "recast layer"). When EDM is used, the processed surface is left with a white layer, which has a different metallurgical structure (e.g., contains considerably more carbon) than the base material. This surface layer (which extends from the surface to a certain depth below the surface) can be more brittle than the base material. Thus, when the working face of a bunter blank is fabricated by EDM, the working face of the resulting bunter (including the raised indicia on the working face) has a white layer, which can cause the raised indicia to be more brittle than the base material. The present cold forming process is advantageous in that it produces a working face devoid of such a white layer.

Thus, in certain embodiments, the bunter blank 10B comprises a steel base material (the bunter blank 10B can optionally consist essentially of the steel base material), and after forming the raised indicia 25 on the working face 15, a surface region SUR (see FIG. 9) of the working face does not have a carbon-enriched surface layer (e.g., contains substantially the same amount of carbon as the steel base material).

Figure 5:
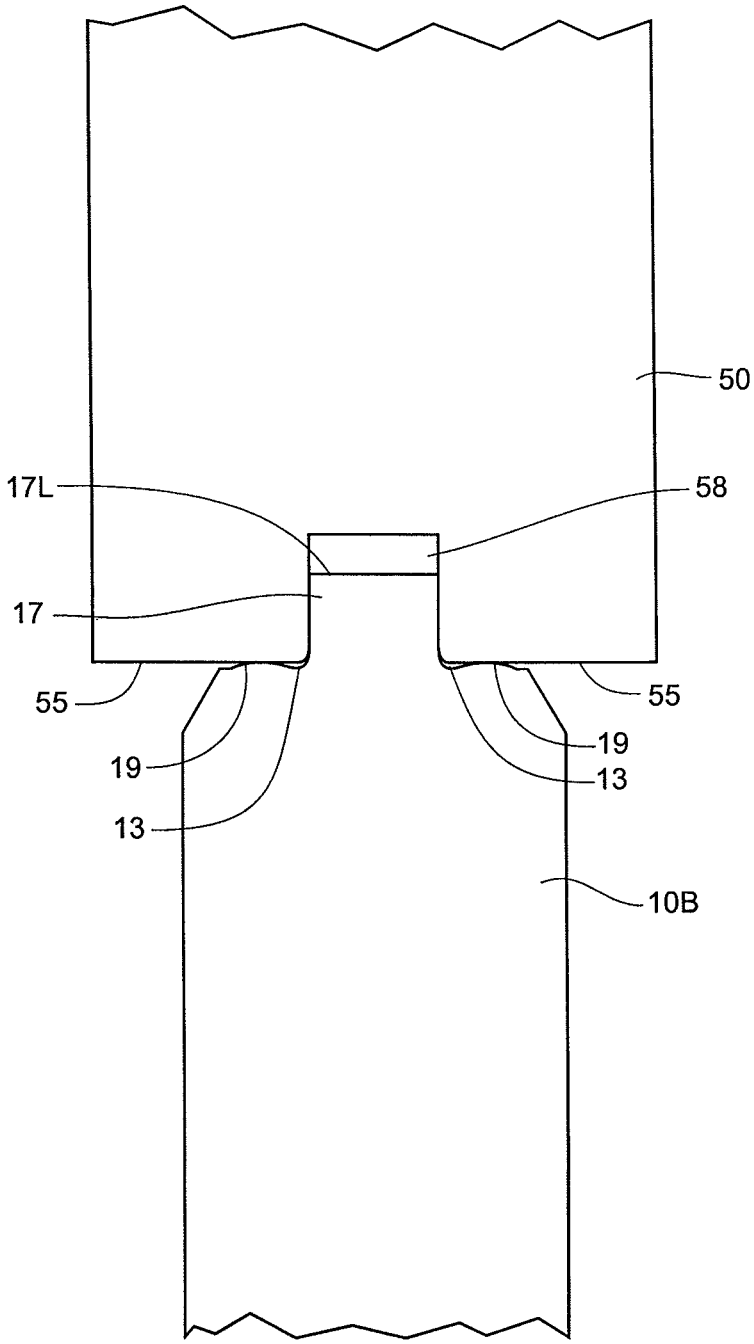
FIG. 5 is a broken away cross-sectional side view showing a leading end region of a bunter blank in engagement with a working end of a hub in accordance with certain embodiments of the invention.
Figure 6B:
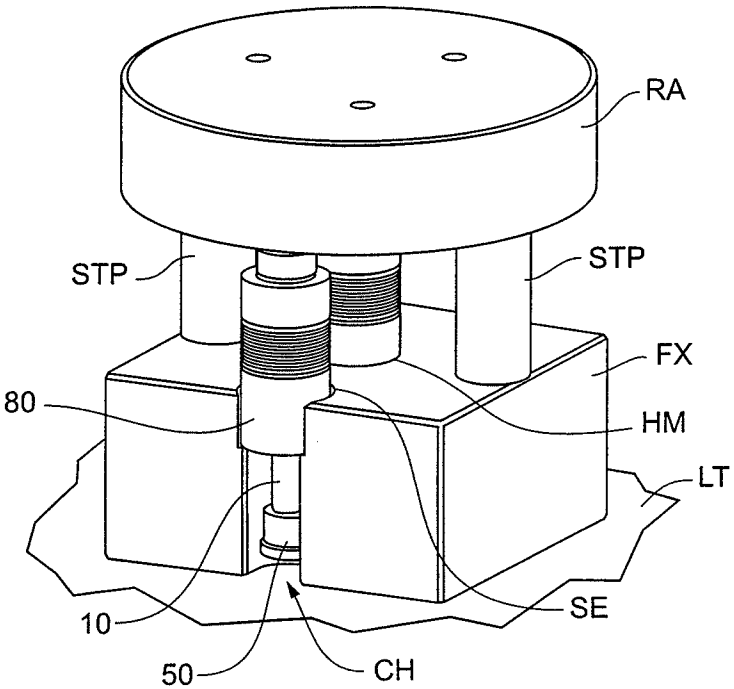
FIG. 6B is a perspective view of the fixture mounted on the press of FIG. 6A, with the ram of the press engaging stops on the fixture in accordance with certain embodiments of the invention.
Figure 6A:
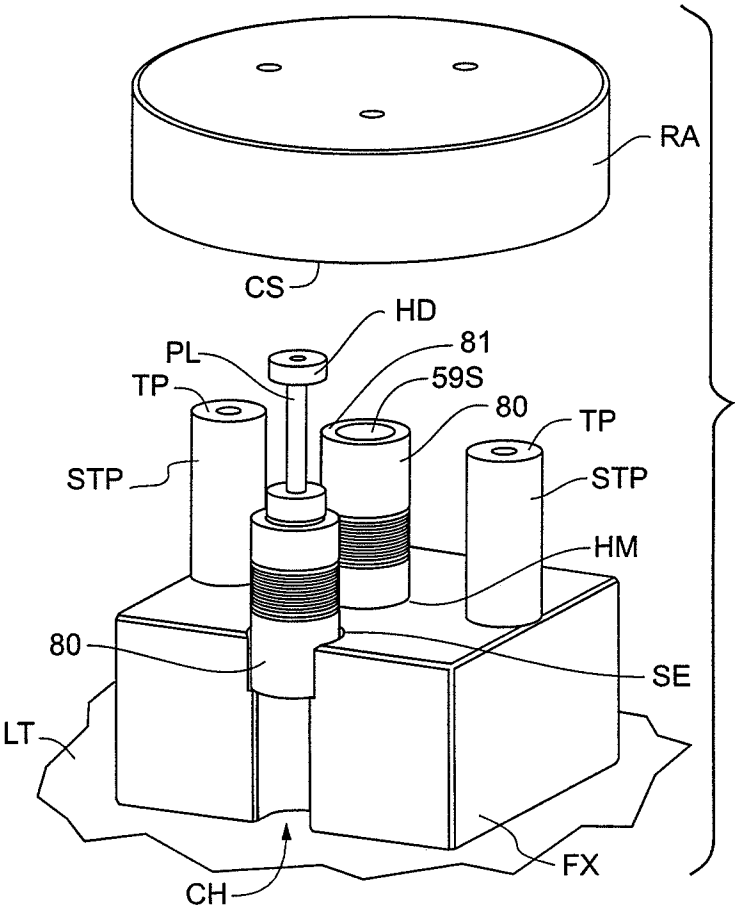
FIG. 6A is a perspective view of a fixture mounted on a press with a ram of the press spaced above the fixture in accordance with certain embodiments of the invention.
Figure 7A:
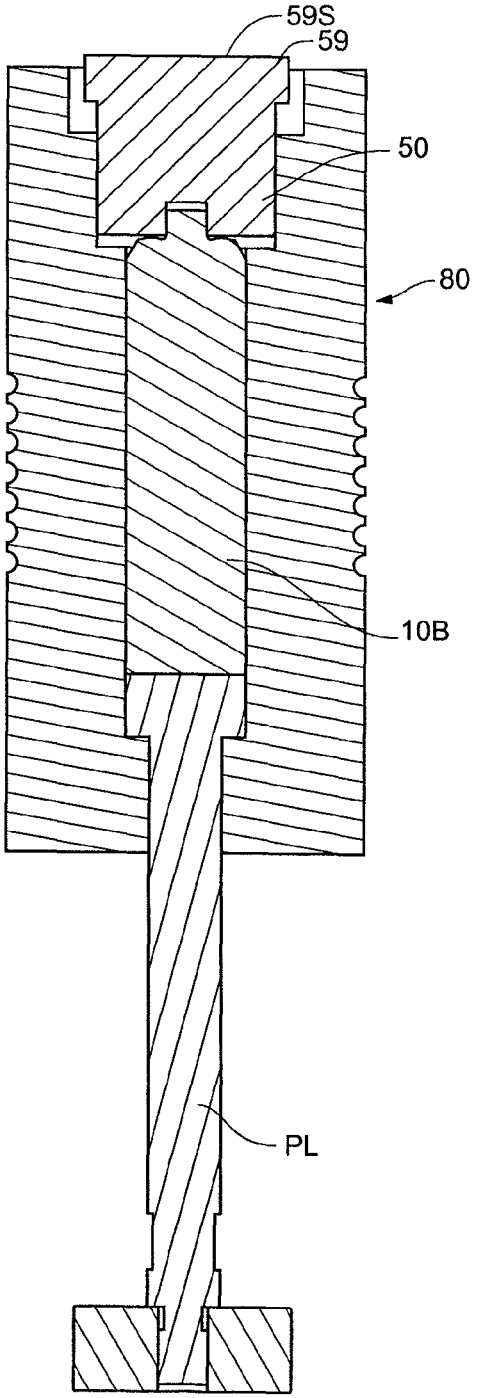
FIG. 7A is a cross sectional side view of a bunter blank assembled together with a hub inside a retainer in accordance with certain embodiments of the invention, the assembly being shown prior to cold forming.
Figure 7B:
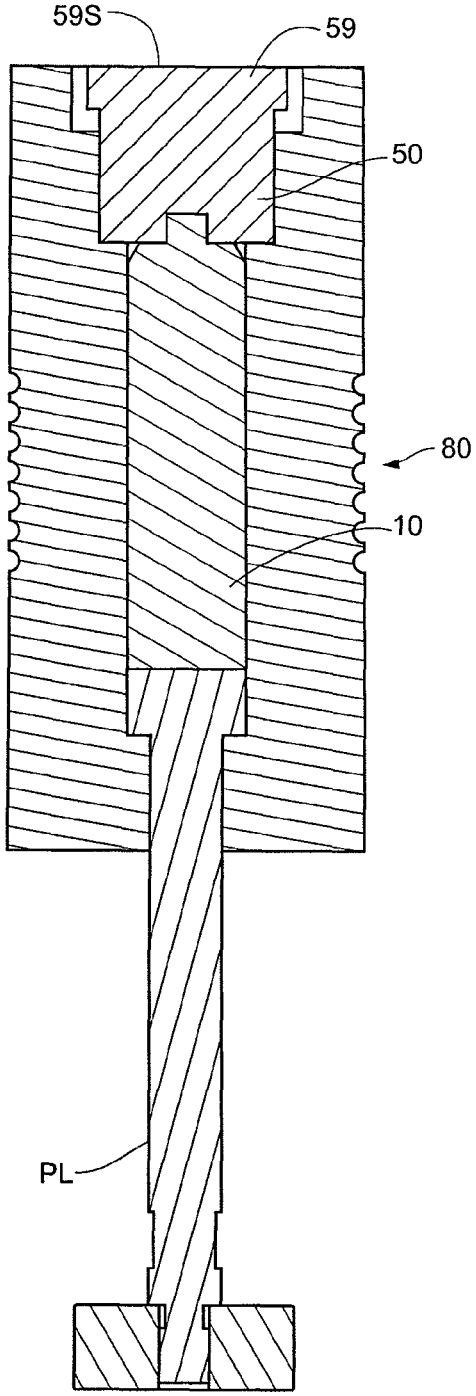
FIG. 7B is a cross sectional side view of the assembly of FIG. 7A, the assembly being shown after cold forming.
Figure 8:
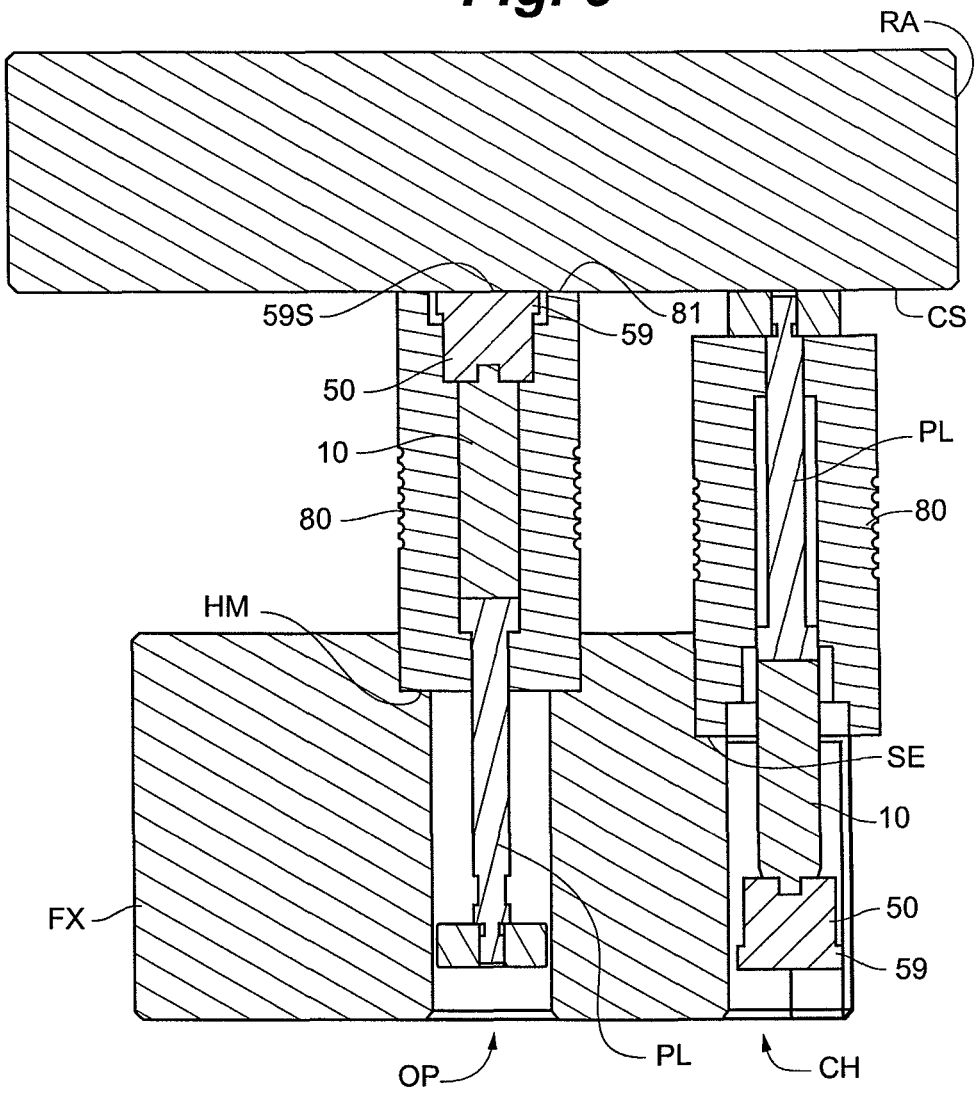
FIG. 8 is a cross sectional view of the cold forming system of FIG. 6B, the ram of the press being shown in engagement with both of the illustrated retainers.

The present cold forming process is perhaps best understood with reference to FIGS. 5, 6A, and 6B. FIGS. 6A and 6B depict embodiments in which a fixture FX is provided on a lower table LT of a press. Here, the fixture FX has two stops STP configured to limit the downward movement of the ram RA (which occurs during the cold forming process). The number and type of stops used can, of course, be varied. The illustrated fixture FX includes a cold forming mount HM and a removal mount SE. The cold forming mount HM is configured to stably secure a retainer 80 in a cold forming position. The retainer 80 has an interior opening in which the bunter blank 10B and hub 50 can be positioned. Preferably, the bunter blank 10B and hub 50 are assembled together inside the retainer 80 in the manner depicted in FIG. 5. Here, the working face 15 of the bunter blank 10B is positioned against the contact face 55 of the hub 50 such that the bunter blank's radial center protrusion 17 is received in the hub's center pocket 58. In the embodiment illustrated, a peak of the hump 19 is aligned with the hub's indicia recesses 52 when the bunter blank and hub are so assembled within the retainer 80. Preferably, the peak of the hump 19 extends in a circle, the hub's indicia recesses 52 are arranged in a circle, and both of these circles have substantially the same radius, such that when the working face 15 of the bunter blank 10B is properly positioned against the hub's contact face 55 (as shown in FIG. 5), the peak of the hump is aligned with the hub's indicia recesses. The ram RA of the press is used to apply enough force to the thus assembled bunter blank 10B and hub 50 that material defining the hump 19 is deformed into the indicia recesses 52 of the hub so as to form raised indicia 25 on the working face 15. In the embodiment illustrated, force is applied so as to press the hub 50 against the bunter blank 10B; the bunter blank is mounted such that it does not move substantially in response to this application of force other than by having material forming its hump 19 deform into the hub's indicia recesses 52. In the present method, the hub 50 moves slightly (during pressing) as the hump 19 on the bunter blank 10B is generally flattened. If desired, the positioning of the hub 50 and the bunter blank 10B could be reversed (using a different retention system) such that force from the ram is applied so as to press the bunter blank against the hub.

In FIG. 6A, an end surface 59S of the hub's base 59 is spaced upwardly from the uppermost surface 81 of the first retainer 80. As a result, when the ram RA descends, it contacts the base 59 of the hub 50, thereby pressing the hub downwardly against the bunter blank 10B. This causes the hump 19 on the bunter blank's working face 15 to be generally flattened while some of the material from the hump deforms into the hub's indicia recesses 52. Thus, the working face 15 of the resulting bunter 10 defines raised indicia 25 but is otherwise generally flat. The descent of the ram RA is stopped at the appropriate position when the ram contacts the stop surfaces TP of the stops STP.

The fixture FX shown in FIGS. 6A and 6B is advantageous in that it enables a single stroke of the ram RA to accomplish two operations. Specifically, it accomplishes the cold forming of a bunter blank in a first retainer while simultaneously removing a completed bunter from a second retainer. As shown in FIG. 6A, the second retainer 80 has a plunger PL that is engaged by the downwardly moving ram RA and is thereby moved forcibly in a downward direction, such that once a bottom end of this plunger contacts the base BA of the completed bunter 10 in the second retainer, this bunter is forced downwardly and out of its retainer along with the hub 50 in that retainer. FIG. 6B shows a bunter 10 and hub 50 dropping out of the second retainer 80. The present cold forming process is by no means limited to use of such a dual-purpose fixture. However, it is currently preferred.

The retainer 80 preferably is formed of A8 material, although other suitable materials include tool steel or high speed steel. The hub 50 preferably is formed of tool steel, such as CPMM4 material, although other suitable materials include high speed steel. In certain preferred embodiments, the hub 50 has a Rockwell C hardness of at least 56. Preferably, the hub 50 is heat treated to at least this minimum hardness. The hub 50 can optionally also include a surface treatment, such as a CVD, PVD, or diffusion type coating.

Exemplary methods for fabricating the hub 50 will now be described. In one method, the hub 50 is formed of tool steel, such as CPMM4 material, although other suitable materials can be used, as noted above. Another exemplary method for fabricating the hub 50 involves the hub 50 being derived from cold work tool steel formed by powder metallurgy processing, similar to that already described herein with respect to the bunter blank. The hub 50 is machined in a lathe turning center to near net finish diameter of 0.750 inch, with a depth of 0.175 inch for pocket 58, and a diameter of 0.875 inch for the base 59. The recessed indicia 52 are then hard milled using a milling center to a depth of 0.0025 inch. Then the hub 50 is heat treated to a minimum hardness of 56 Rockwell C. The hub is then turned in a lathe turning center to the finish diameter of 0.750 inch and the base 59 to a diameter of 0.875 inch. The final step is to break the edges of the recessed indicia using polishing technology. These exemplary details are by no means limiting to the invention.

One exemplary method for fabricating the retainer 80 will now be described. In the present method, the retainer 80 is formed of A8 material, although other suitable materials can be used. The retainer 80 is turned out of an A8 material blank on lathe and most of the features are added and some material is left for finishing. Then, an air release nip is added in a mill. 0.094 inch dia. 0.015 inch deep. Next, the part is sent to heat treat and the part is drawback to RC 52-54. After heat treat, the part is put on a grinder and the outside diameter is ground to 1.525 inches and there is a clean-up grind on the ends to square the part up. The retainer then goes to a jig grinder and the two inside diameters are ground out to 0.750 inch and 0.508 inch and the bottom of the holes are cleaned up. Finally, the ends of the retainer are ground so there is 0.500 inch from bottom of 0.508 hole and bottom of retainer and the overall length is ground to 3.362 inches. Here again, the noted exemplary details are not limiting to the invention.

One exemplary method for fabricating the fixture FX will now be described. In the present method, the fixture FX is formed of A2 material, although many other suitable materials can be used. The fixture FX is made out of an A2 material block. The block is put in a mill squared up and all the desired features are added. It is then heat treated and the two counter bores are jig ground to size. The fixture is 6.5 inches wide, 6 inches deep, and 3.25 inches high. There are two tapped holes to hold the stops STP. There is a 1.530 inch diameter by 0.485 inch deep counter bore with a 1.015 inch diameter through-hole in the center of the fixture FX. Feature SE has a 1.530 inch diameter counter bore that is 0.880 inch deep and 1.000 inch cut out of the side of the part. Again, the details given here are not limiting to the invention.

In one exemplary embodiment, the bunter 10 is designed for use with 5.56 mm caliber ammunition cases, the bunter blank 10B is of the nature described above in the non-limiting example, the hub 50 is fabricated in the manner described above, the retainer 80 is fabricated in the manner described above, the fixture FX is fabricated in the manner just described, and a hydraulic or mechanical cold forge press is used for the cold forming process. In the present embodiment, the cold forming process happens when the ram RA is moved down vertically and comes into contact with surface 59S of the hub 50. The contacting surface CS of the ram RA continues moving downward vertically until it comes into contact with surfaces TP of the stops STP. Once surfaces CS and TP are flush, the cold forming process is complete, and the ram RA is moved upward vertically to its home position.

The raised indicia 25 on the working face 15 can comprise letters, numbers, and/or other indicia. Commonly, the raised indicia 25 will include manufacturer indicia (i.e., indicia identifying the company that manufactured the case 100). In some cases, the raised indicia 25 will also include year indicia (i.e., indicia identifying the year in which the case 100 was manufactured), caliber indicia (i.e., indicia identifying the caliber or gauge of the case 100), or both.

The raised indicia 25 on the bunter's working face 15 preferably define raised surfaces (i.e., surfaces spaced forwardly of the generally flattened part of the working face) that are planar and generally parallel to the flattened part of the working face. In many cases, the indicia 25 will include a plurality of individual (e.g., separate or "discrete") raised letters, numbers, or both. In such cases, the raised surfaces of the different letters and/or numbers preferably are substantially flush to one another. If desired, the raised surfaces of the indicia 25 can be substantially parallel to a planar leading surface 17L of the radial center protrusion 17. This, however, is not required.

The bunter 10 can optionally have a groove SL formed in, and extending entirely around, the base BA of the bunter. Reference is made to FIG. 2B. Here, the illustrated bunter 10 is defined by a single integral body. However, this is not required. For example, the bunter 10 can alternatively comprise multiple bodies. This can be appreciated by referring to FIG. 3A, which depicts an embodiment in which the bunter is to be formed by two generally cylindrical bodies BA1, BA2 joined together in an end-to-end fashion. Other variants of this nature are also possible.

In the illustrated embodiments, the working face 15 of the bunter blank 10 has a generally ring-shaped configuration, the contact face 55 of the hub 50 has a generally ring-shaped configuration, and the bunter blank's radial center protrusion 17 has a cylindrical configuration. While these configurations will commonly be most convenient, they are not strictly required. For example, the contact face of the hub could be square, hexagonal, or various other shapes. The same is true of the working face of the bunter blank. In most cases, though, the noted configurations will be used.

Figure 9:
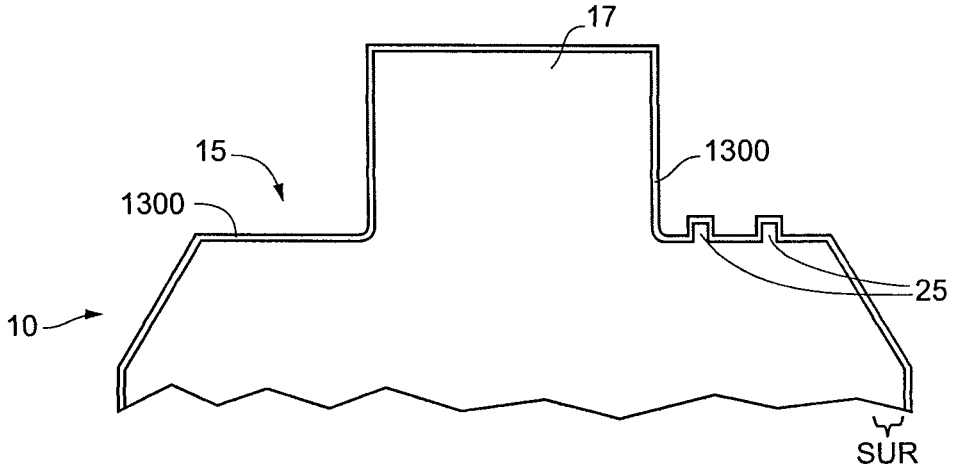
FIG. 9 is a partially broken-away schematic cross-sectional view of a bunter in accordance with certain embodiments of the invention.

In some embodiments, the working face 15 of the bunter 10 is provided with a coating 1300. One exemplary embodiment is shown in FIG. 9. When provided, the coating 1300 can optionally be over the entire working face 15 of the bunter 15. In FIG. 9, the coating 1300 is over the working face 15, including the raised indicia 25, and it is also over the radial center protrusion 17. If desired, the coating 1300 can be over the entire bunter 10. Thus, in some method embodiments, after the formation of the raised indicia 25, the method further includes forming a coating 1300 on the working face 15 of the bunter 10.

The coating 1300 can optionally be a dry lubricant coating. For example, the coating 1300 can comprise nickel (e.g., nickel alloy) and/or a low friction polymer. In some cases, the coated surface has one or more of the following features: (i) a coefficient of static friction below 0.35, below 0.3, or even below 0.2; (ii) a coefficient of dynamic friction below 0.3, below 0.25, below 0.18, or even below 0.1. Useful dry lubricant coatings are available commercially from, for example, General Magnaplate Corporation (Linden, N.J., USA) and Poeton Industries, Ltd. (Gloucester, England). As one example, the coating can be a NEDOX® coating.

In certain embodiments, the coating 1300 comprises a nitride and/or a carbide. One commercially available nitride coating is the Nitrex® coating, which is a high endurance surface enhancement available commercially from Nitrex, Inc. (Aurora, Ill., USA). Particularly useful nitriding and nitrocarburizing enhancements are described in U.S. Pat. No. 6,327,884, the salient teachings of which are incorporated herein by reference.

Nitriding and nitrocarburizing processes are known in the field and need not be described in great detail. Reference is made to U.S. Pat. Nos. 4,790,888 and 4,268,323, the teachings of which regarding such enhancements are incorporated herein by reference. The latter patent refers to the use of a fused salt bath to enable nitrogen and carbon to diffuse into the surface of a steel piece suspended in the bath to form a carbonitride case. Reference is made also to U.S. Pat. No.

5,234,721 (referring to methods of forming carbonitride coatings), the teachings of which regarding such coatings are incorporated herein by reference.

Nitriding processes, both plasma (ion) nitriding and liquid nitriding, are described in detail in the ASM Handbook prepared under the direction of the ASM International Handbook Committee, Revised vol. 4: *Heat Treating*, pp. 410-424 (1994), the teachings of which concerning nitriding enhancements are incorporated herein by reference. Plasma or ion nitriding involves the use of glow discharge technology to provide nascent nitrogen to the surface of a heated steel part. Here, the part is subjected to a nitrogen plasma in a vacuum chamber. Nascent nitrogen diffuses into the surface of the part to form an outer "compound" zone containing $\gamma$ ($Fe_4N$) and $\epsilon$ ($Fe_{2,3}N$) intermetallics, and an inner "diffusion" zone which may be described as the original core microstructure with some solid solution and precipitation strengthening. Liquid nitriding involves immersing a steel part in a molten, nitrogen-containing fused salt bath containing cyanides or cyanates, e.g., NaCN or NaCNO. Steel components can be enhanced by liquid nitriding through a wide variety of commercial coating manufacturers, such as Metal Treaters Inc. of St. Paul, Minn., USA. As used herein, the term coating includes discrete coatings on the surface of a part, diffusion of material into the part so as to enhance its surface, etc.

While the coating 1300 may be advantageous in some embodiments, it is by no means required. Thus, the bunter 10 need not have any coating(s).

While a preferred embodiment of the present invention has been described, it should be understood that various changes, adaptations and modifications may be made therein without departing from the spirit of the invention and the scope of the appended claims.

What is claimed is:

1. A method of producing a bunter that is configured to stamp recessed headstamp indicia into a base of an ammunition cartridge case, the method comprising providing a bunter blank having a generally ring-shaped working face from which projects a radial center protrusion, the radial center protrusion being configured for receipt in a primer pocket of the cartridge case's base during stamping of the recessed headstamp indicia, the bunter blank's generally ring-shaped working face surrounding the radial center protrusion and having an outwardly rounded configuration, wherein the outwardly rounded configuration of the bunter blank's working face is located radially outside of an inwardly radiused section adjacent to a base portion of the radial center protrusion, the method comprising providing a hub having a generally ring-shaped contact face that defines indicia recesses, the generally ring-shaped contact face of the hub surrounding a central pocket, the method comprising assembling the generally ring-shaped working face of the bunter blank against the generally ring-shaped contact face of the hub such that the bunter blank's radial center protrusion is received in the hub's central pocket and applying enough force to the thus assembled bunter blank and hub that material defining the outwardly rounded configuration of the bunter blank's working face is deformed into the hub's indicia recesses so as to form raised indicia on said working face.

2. The method of claim 1 wherein the outwardly rounded configuration of the bunter blank's working face has an aspect ratio of greater than 3.5.

3. The method of claim 2 wherein said aspect ratio is greater than 7.

4. The method of claim 3 wherein said aspect ratio is greater than 9.

5. The method of claim 1 wherein the outwardly rounded configuration of the bunter blank's working face is defined by a generally toroidal surface.

6. The method of claim 5 wherein the generally toroidal surface is defined by a single hump encircling the radial center protrusion.

7. The method of claim 6 wherein the hump has a height of between 0.005 inch and 0.015 inch.

8. The method of claim 1 wherein, during said forming of the raised indicia on the working face, said outwardly rounded configuration is generally flattened.

9. The method of claim 1 wherein, after said forming of the raised indicia on the working face, the working face has an average surface roughness Ra of less than 50 microinches.

10. The method of claim 9 wherein said average surface roughness Ra is less than 25 microinches.

11. The method of claim 10 wherein said average surface roughness Ra is less than 10 microinches.

12. The method of claim 1 wherein the bunter blank's radial center protrusion has a cylindrical configuration.

13. The method of claim 1 wherein a press is used to apply said force to the assembled bunter blank and hub, the method comprising operating the press such that the force is at least 12 tons.

14. The method of claim 13 wherein the bunter blank and the hub are both formed of metal.

15. The method of claim 14 wherein at least one of the bunter blank and the hub is formed of annealed tool steel.

16. The method of claim 14 wherein at least one of the bunter blank and the hub is derived from cold work tool steel formed by powder metallurgy processing.

17. The method of claim 14 wherein said forming of the raised indicia on the working face is initiated while the bunter blank is at room temperature.

18. The method of claim 17 wherein the raised indicia formed on said working face comprise letters, numbers, or both.

19. The method of claim 1 wherein the bunter blank comprises a steel base material, and wherein after the formation of said raised indicia a surface region of the working face contains substantially the same amount of carbon as does the steel base material.

20. The method of claim 1 wherein, after the formation of said raised indicia, the method further comprises forming a coating on the working face.

21. The method of claim 20 wherein the coating comprises a nitride, a carbide, or both.

22. The method of claim 1 wherein the bunter is configured for use in stamping machinery with regard to the ammunition cartridge case.

23. A method of producing a bunter that is configured to stamp recessed headstamp indicia into a base of an ammunition cartridge case, the method comprising providing a bunter blank having a generally ring-shaped working face from which projects a radial center protrusion, the radial center protrusion being configured for receipt in a primer pocket of the cartridge case's base during stamping of the recessed headstamp indicia, the bunter blank's generally ring-shaped working face surrounding the radial center protrusion and having an outwardly rounded configuration, wherein the working face of the bunter blank defines a planar surface encircling the outwardly rounded configuration, the method comprising providing a hub having a generally ring-shaped contact face that defines indicia recesses, the generally ring-shaped contact face of the hub surrounding a central pocket, the method comprising assembling the generally ring-shaped working face of the bunter blank against the generally ring-shaped contact face of the hub such that the bunter blank's radial center protrusion is received in the hub's central pocket and applying enough force to the thus assembled bunter blank and hub that material defining the outwardly rounded configuration of the bunter blank's working face is deformed into the hub's indicia recesses so as to form raised indicia on said working face.

24. The method of claim 23 wherein the outwardly rounded configuration of the bunter blank's working face is defined by a generally toroidal surface and the planar surface is generally ring shaped.

25. A method of producing a bunter that is configured to stamp recessed headstamp indicia into a base of an ammunition cartridge case, the method comprising providing a bunter blank having a working face from which projects a radial center protrusion, the radial center protrusion being configured for receipt in a primer pocket of the cartridge case's base during stamping of the recessed headstamp indicia, the bunter blank's working face having a hump that encircles the radial center protrusion, wherein the working face of the bunter blank defines a planar surface encircling the hump, the method comprising providing a hub having a contact face that defines indicia recesses, the contact face of the hub surrounding a central pocket, the method comprising assembling the working face of the bunter blank against the contact face of the hub, such that a peak of the hump is aligned with the indicia recesses and such that the radial center protrusion is received in the central pocket, and applying enough force to the thus assembled bunter blank and hub that material defining the hump is deformed into the indicia recesses so as to form raised indicia on said working face.

26. The method of claim 25 wherein the working face of the bunter blank has a generally ring-shaped configuration, the contact face of the hub has a generally ring-shaped configuration, and the bunter blank's radial center protrusion has a cylindrical configuration.

27. The method of claim 25 wherein the hump on the bunter blank's working face has an aspect ratio of greater than 7.

28. The method of claim 25 wherein the hump on the bunter blank's working face has a height of between 0.005 inch and 0.015 inch.

29. The method of claim 25 wherein the hump on the bunter blank's working face is defined by a toroidal surface.

30. The method of claim 25 wherein, during said forming of the raised indicia on the working face, the hump is generally flattened.

31. The method of claim 25 wherein, after said forming of the raised indicia on the working face, the working face has an average surface roughness Ra of less than 25 microinches.

32. The method of claim 25 wherein the bunter is configured for use in stamping machinery with regard to the ammunition cartridge case.

33. The method of claim 25 wherein the hump of the bunter blank's working face is defined by a generally toroidal surface and the planar surface is generally ring shaped.

34. A method of producing a bunter that is configured to stamp recessed headstamp indicia into a base of an ammunition cartridge case, the method comprising providing a bunter blank having a working face from which projects a radial center protrusion, the radial center protrusion being configured for receipt in a primer pocket of the cartridge case's base during stamping of the recessed headstamp indicia, the bunter blank's working face having a hump that encircles the radial center protrusion, wherein the hump on the bunter blank's working face is located radially outside of an inwardly radiused section adjacent to a base portion of the radial center protrusion, the method comprising providing a hub having a contact face that defines indicia recesses, the contact face of the hub surrounding a central pocket, the method comprising assembling the working face of the bunter blank against the contact face of the hub, such that a peak of the hump is aligned with the indicia recesses and such that the radial center protrusion is received in the central pocket, and applying enough force to the thus assembled bunter blank and hub that material defining the hump is deformed into the indicia recesses so as to form raised indicia on said working face.

* * * * *